US007047704B1

(12) United States Patent
Han

(10) Patent No.: US 7,047,704 B1
(45) Date of Patent: May 23, 2006

(54) METHOD FOR DESIGNING AND FABRICATING MULTI-STEP TENSION PRESTRESSED GIRDER

(75) Inventor: Man-yop Han, Suwon (KR)

(73) Assignee: Interconstec Co., Ltd., Seoul (KR)

( * ) Notice: Subject to any disclaimer, the term of this patent is extended or adjusted under 35 U.S.C. 154(b) by 315 days.

(21) Appl. No.: 10/110,171

(22) PCT Filed: Oct. 7, 2000

(86) PCT No.: PCT/KR00/01117

§ 371 (c)(1),
(2), (4) Date: Apr. 5, 2002

(87) PCT Pub. No.: WO01/27406

PCT Pub. Date: Apr. 19, 2001

(30) Foreign Application Priority Data

Oct. 8, 1999 (KR) ..... 1999/43513

(51) Int. Cl.
*E04B 1/20* (2006.01)

(52) U.S. Cl. ..... 52/745.19; 52/223.8; 52/223.14; 52/741.1; 52/745.17; 52/745.18

(58) Field of Classification Search ..... 52/223.8, 52/223.14, 741.1, 745.17, 745.19
See application file for complete search history.

(56) References Cited

U.S. PATENT DOCUMENTS 2,319,303 A * 5/1943 Crawford
2,786,242 A * 3/1957 Stephens
2,856,644 A * 10/1958 Dunham
3,290,840 A * 12/1966 Middendorf
5,471,812 A * 12/1995 Muller ..... 52/745.19
5,806,259 A * 9/1998 Smith ..... 52/223.12
6,065,257 A * 5/2000 Nacey et al. ..... 52/223.8
6,385,940 B1 * 5/2002 Maier et al. ..... 52/730.2
6,389,766 B1 * 5/2002 Jackson ..... 52/291

FOREIGN PATENT DOCUMENTS

| | | |
|---|---|---|
| DE | 1 658 629 | 10/1970 |
| FR | 2 587 394 | 3/1987 |
| KR | P1999-068518 | 9/1999 |
| WO | WO 00/68508 | 11/2000 |

OTHER PUBLICATIONS

Notice to Submit Response issued by the Korean Intellectual Property Office on May 27, 2004 in corresponding application 10-1999-0043513.

* cited by examiner

*Primary Examiner*—Carl D. Friedman
*Assistant Examiner*—Yvonne M. Horton
(74) *Attorney, Agent, or Firm*—Buchanan Ingersoll PC

(57) ABSTRACT

In a method for designing a multi-step tension prestressed girder, prestress is appropriately introduced with respect to a relationship between a load and stress, for each step of construction, so that the height of a profile of the girder can be reduced. In a method for fabricating a multi-step tension prestressed girder, prestress is appropriately introduced with respect to a relationship between a load and stress, for each step of construction, so that the height of a profile of the girder can be reduced.

3 Claims, 5 Drawing Sheets

① $P_1$ ② $P_1 + M_{d1}$ ③ $P_e + M_{d1}$ ④ $P_e + M_{d1} + M_{d2} + M_1$

PRIOR ART (1) $P_{i1} + M_{d1}$ (2) $P_{i1} + M_{d1} + M_{d2}$ (3) $P_{i1} + M_{d1} + M_{d2} + P_{i2}$

④ $(1+R)(P_{i1}+P_{i2})/2 + M_{d1} + M_{d2}$

⑤ $(1+R)(P_{i1}+P_{i2})/2 + M_{d1} + M_{d2} + M_{d3}$

⑥ $R(P_{i1}+P_{i2}) + M_{d1} + M_{d2} + M_{d3}$

⑦ $R(P_{i1}+P_{i2}) + M_{d1} + M_{d2} + M_{d3} + M_1$

METHOD FOR DESIGNING AND FABRICATING MULTI-STEP TENSION PRESTRESSED GIRDER

BACKGROUND OF THE INVENTION

1. Field of the Invention

The present invention is related to a design of a girder for a bridge or for use in construction, and more particularly, to a method for designing and fabricating a multi-step tension prestressed girder to increase a load bearing force of a bridge, when necessary, by adjusting tension step by step during construction.

2. Description of the Related Art

FIG. 1 shows the arrangement of steel wires between girders according to a conventional design. Referring to the drawing, a prestressed concrete girder 11 includes an upper flange 13, a lower flange 14, and a body 15. A steel wire 12 is installed lengthwise in the girder 11 from end to end through the body 15, near the lower flange 14. In the conventional girder design, girders having various profiles is have been developed to be sturdier and longer in an effort to improve the efficiency of a member. However, there have been no remarkable developments in basic methods of introducing prestress to the member and the conventional design methods have still been used. In the conventional design which is based on an allowed stress design concept, a girder is fabricated as a precast member in a factory or is directly fabricated at a construction site, and then a required tension in view of a designed load is initially applied once to the girder. The tension should be applied such that the prestress occurring at this time can be greater than a total bending stress generated in the girder due to a dead load and a live load added thereto. Also, since a tension process is performed only one time, great prestress, considering an overall loss of tension, needs to be introduced initially. Accordingly, the area and height of the profile of the girder should be initially sufficient to bear the prestress.

FIG. 2 shows a relationship between load and stress according to the conventional design method. Prestress generated by tension $P_1$ introduced in a pretension or post-tension method after a girder has been fabricated is distributed as indicated by a line 1. However, such a state is theoretical. Actually, since a bending moment $M_{d1}$ due to the weight of the girder itself exists prior to the introduction of tension, the distribution of stress in which the bending stress due to the self-weight and the prestress have been synthesized is shown by a line 2. Here, the tensile stress in an upper margin of the girder should not exceed $\sigma_{ti}$ and the compression stress in a lower margin of the girder should not exceed $\sigma_{ci}$.

When loss of tension occurs by lapse of time in the stress distribution state of line 2, prestress is reduced so that the distribution of stress moves to a line 3. That is, tensile stress decreases by $\Delta\sigma_1$ in the upper margin and compresion stress decreases by $\Delta\sigma_2$ in the lower margin.

Here, when the additional dead load moment $M_{d2}$ and the live load $M_1$ are introduced, the distribution of stress becomes as shown by a line 4 of FIG. 2. The stress in the lower margin should not exceed $\sigma_{ts}$ and the stress in the upper margin should not exceed $\sigma_{cs}$.

Required profile coefficients $Z_1$ and $Z_2$ with respect to the upper margin and the lower margin of the profile of a girder having the above stress distribution should satisfy the following Equations 1 and 2.

$$Z_1 \geq \frac{(1-R)M_{d1} + M_{d2} + M_l}{\sigma_{cs} - R\sigma_{ti}} \quad \text{[Equation 1]}$$

$$Z_2 \geq \frac{(1-R)M_{d1} + M_{d2} + M_l}{R\sigma_{ci} - \sigma_{ts}} \quad \text{[Equation 2]}$$

In FIG. 2 and Equations 1 and 2, the required profile coefficient of the member according to the conventional design method in which prestress is introduced only once is calculated in consideration of the self-weight of the girder and additional dead and live loads. However, as the span increases, the bending moment due to the load increases in proportion to the square of the distance of the span. Accordingly, as the span of the girder increases, the profile of the girder increases. Then, the bending moment due to the self-weight further increases so that the member itself is made large. Therefore, though the profile of the member is deformed to improve the efficiency of withstanding stress, the aforesaid basic problem cannot be solved and this fact has been a great disadvantage in designing a long-span bridge using a PSC I-type girder.

All problems generated in a bridge can be solved by adjusting the tension of the girder used therefor. Thus, the present invention provides a solution which is simple and inexpensive.

SUMMARY OF THE INVENTION

To solve the above problems, it is an object of the present invention to provide a method for designing and fabricating a multi-step tension prestressed girder for a bridge in which, considering that loads are applied step by step during construction of a bridge, tension is introduced step by step to a prestressed concrete girder according to an increase of the load.

In the present invention, by adopting the multi-step tension type design method, designing a bridge with a small profile having a span much longer than that according to conventional technology is possible.

To achieve the above object, a girder having a built-in steel wire which can be adjusted according to the present invention includes at least one steel wire installed in a lower flange of the girder in a lengthwise direction. Thus, by increasing the tension in the steel wire, a load bearing force of the girder can be improved.

According to one aspect of the present invention, there is provided a method for designing a multi-step tension prestressed girder, in which prestress is appropriately introduced with respect to a relationship between a load and stress for each step of construction, so that the height of a profile of the girder can be reduced.

According to another aspect of the present invention, there is provided a method for fabricating a multi-step tension prestressed girder, wherein prestress is appropriately introduced with respect to a relationship between a load and stress for each step of construction, so that the height of a profile of the girder can be reduced.

It is preferable in the present invention that the construction steps are divided into those of a non-synthesis profile and those of a synthesis profile according to whether or not the girder is to be synthesized with a bottom concrete plate.

Also, it is preferable in the present invention that primary tension is applied at the initial stage in which a girder mold is solidified and a secondary tension is applied after the bottom concrete plate is installed.

The present invention can be applied to various types of girders regardless of whether the shape of the profile of the girder is that of an I-type girder or a bulb T-type girder or some other shapes. Since a slab is considered to be a girder of a rectangular profile having a unit width, the following preferred embodiment of the present invention will be described with respect to an I-type girder.

BRIEF DESCRIPTION OF THE DRAWINGS

The above objective(s) and advantages of the present invention will become more apparent by describing in detail a preferred embodiment thereof with reference to the attached drawings in which.

DETAILED DESCRIPTION OF THE INVENTION

Figure 3:
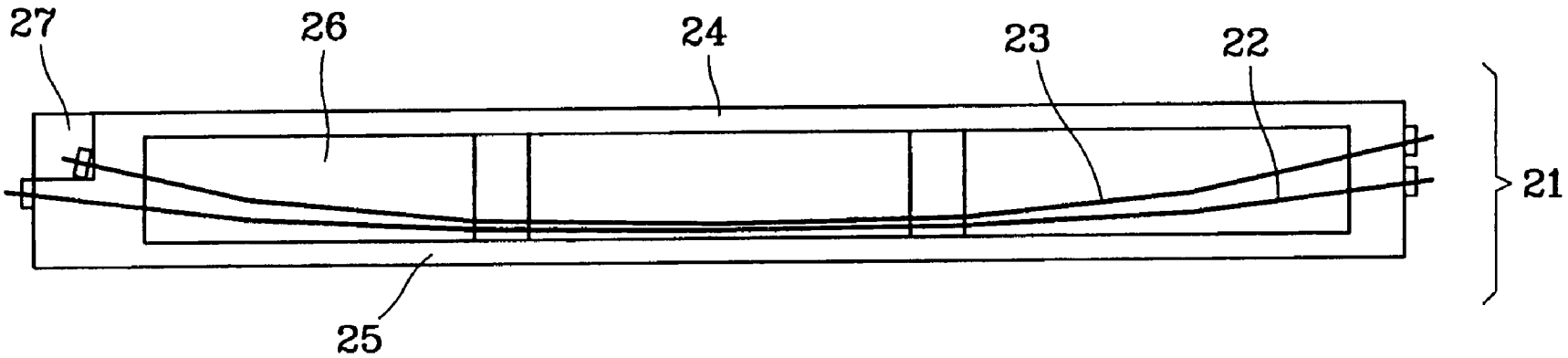
FIG. 3 is a view showing the arrangement of steel wires between girders according to the present invention.

Referring to FIG. 3, a girder designed according to the present invention includes at least two steel wires. One of the steel wires is tightened when a girder is fabricated so that it can bear the self-weight thereof when the girder is installed on piers while the other can be tightened later when a slab is installed above the girder.

A girder 21 of the present invention, as shown in FIG. 3, includes an upper flange 24, a lower flange 25, and a body 26. At least two steel wires 22 and 23 are installed lengthwise throughout a lower end of the body 26 and the lower flange 25 of the girder 21.

Also, one steel wire 23 of the steel wires 22 and 23 is preferably installed inside the lower flange 25 in a lengthwise direction to be symmetric with respect to the center of the profile. In view of the profile of the girder 21, the upper flange 24 is installed horizontally at the upper portion of the body 26 and an upper plate of a bridge is installed on the upper flange 24. In view of the profile of the girder 21, the lower flange 25 is installed horizontally at the lower margin of the body 26 and the bottom surface thereof is supported by piers.

The steel wires 22 and 23 distributed mainly at the lower end of the girder 21, as shown in FIG. 3, are arranged to be evenly distributed throughout the entire area of a cross-section taken at either end of the girder 21. That is, at both end portions of the girder 21, the steel wires should be evenly distributed to be symmetrical in four directions so that tension by the steel wires 22 and 23 can be evenly distributed over the entire surface of the profile of the girder 21.

When additional steel wires are arranged outside the girder 21, appropriate anchoring devices should be installed at both end portions of the girder so that these steel wires can be anchored at both end portions of the girder. Since a latitudinal beam installed at both end portions of the existing girder is not designed to bear tension generated by a tension member, an additional anchoring device 27 is installed or the latitudinal beam at both end portions of the girder is appropriately reinforced to bear the tension.

In the girder 21 according to the present invention, when a crack or excess sag is generated due to a long-term load, the steel wire 22 installed inside or outside the girder 21 is additionally tightened for reinforcement of the girder 21. Here, the additional tightening of the steel wire 22 is performed by using a hydraulic jack.

The design method of the present invention will be described according to a multi-step tension member introduction principle.

As long as a conventional method is used to design a long-span bridge with PSC I-type girders, there is a limit in a profile coefficient regardless of the stress withstanding efficiency of the profile. As a countermeasure for overcoming disadvantages in the conventional design method for the PSC I-type girder, a method of introducing prestress according to each step of construction is suggested. In the steps of construction, a non-synthesis profile and a synthesis profile are separately applied according to whether the bottom concrete plate and the girder are synthesized or not.

Non-Synthesis Step

When prestress by a post-tension method is appropriately introduced according to the state of stress for each construction step, a design span can be increased while maintaining the same profile height. Also, while maintaining the same span, the height can be reduced more than when designing a member by the conventional design method.

Figure 4:
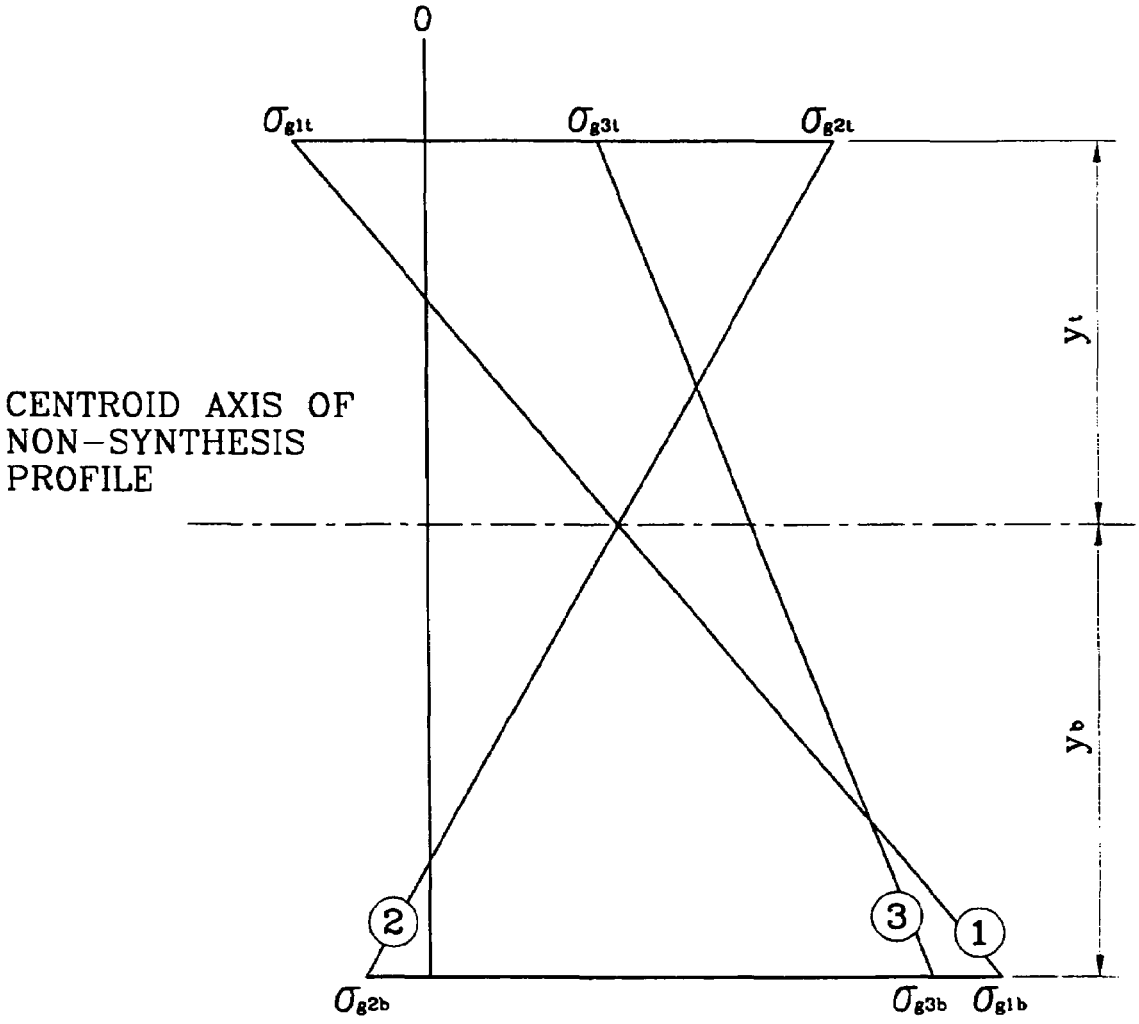
FIG. 4 is a graph showing the relationship between load and stress in a design method of the present invention.

FIG. 4 shows the relationship between load and stress of a non-synthesis profile according to the design method of the present invention. In the drawing, a line 1 indicates the distribution of stress in a step of introducing prestress by applying tension primarily. In this step, since bending stress due to the self-weight of the member exists, the bending stress and prestress are combined. Also, in this step, the upper margin stress $\sigma_{g1t}$ and the lower margin stress $\sigma_{g1b}$ of the girder can be calculated in the conventional method which uses an allowed stress design concept. That is, $$\sigma_{g1t} = \frac{P_{i1}}{A_g} - \frac{P_{i1} \cdot e_1}{Z_{gt}} + \frac{M_{d1}}{Z_{gt}} \qquad \text{[Equations 3]}$$

$$\sigma_{g1b} = \frac{P_{i1}}{A_g} + \frac{P_{i1} \cdot e_1}{Z_{gb}} - \frac{M_{d1}}{Z_{gb}}$$

Here, $P_{i1}$ is a primary tension, $A_g$ is an area of the profile of the girder, $e_1$ is an eccentric distance of the primary tension, that is, the distance from the geometric center of the primary tension, $M_{d1}$ is a bending moment due to the self-weight, and $Z_{gt}$ and $Z_{gb}$ are coefficients of the profile of the girder with respect to the upper margin and the lower margin.

The stress calculated by Equations 3 should be a value between an allowed tensile stress $\sigma_{ti}$ and an allowed compression stress $\sigma_{ci}$ of concrete shortly after tension is introduced. Here, when the eccentric distance of a tension member is adjusted by appropriately lowering the height of the profile, generation of tensile stress in the upper margin of the girder can be avoided. That is, the girder can be designed such that the compression stress can act on the entire profile.

Figure 1:
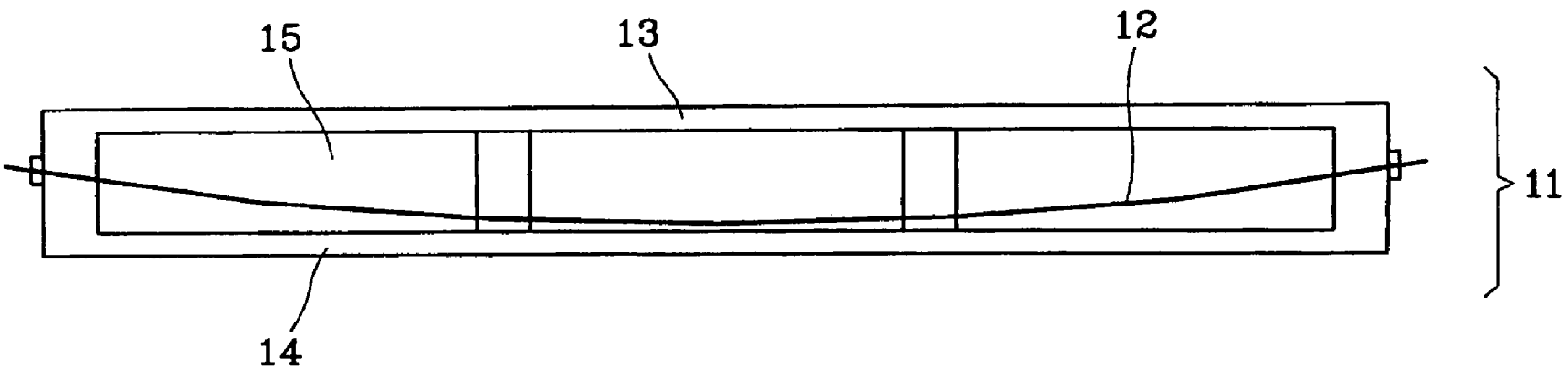
FIG. 1 PRIOR ART
FIG. 1 is a view showing the arrangement of steel wires between girders according to the conventional technology.
Figure 2:
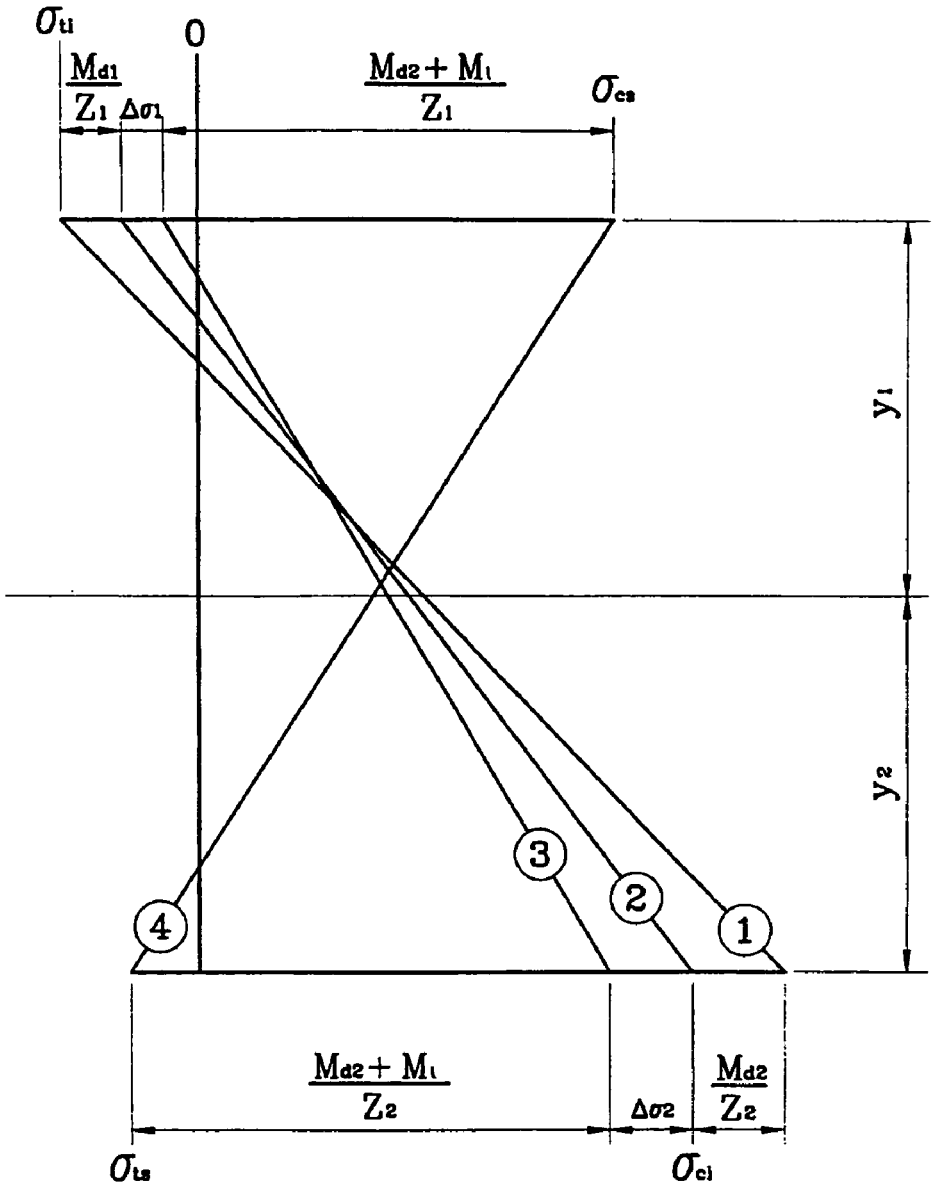
FIG. 2 is a graph showing the relationship between load and stress according to the conventional design method.

A line 2 indicates the distribution of stress in the profile shortly after a bottom concrete plate is installed. Since the eccentric distance and centroid distance, which is the distance from the center of mass, are shortened if the height of the profile is lowered, unlike FIG. 2, the stress due to the load of the bottom plate at the upper and lower margins of girder changes much.

Shortly after the installation, the bottom concrete plate does not perform a structural function but acts as a load. As a result, the stress in this step is a value which is obtained by adding the bending stress due to the inactive moment $M_{d2}$ of the bottom concrete plate to $\sigma_{g2}$ obtained from Equations 3. Thus, the stress $\sigma_{g2}$ of the profile shortly after the installation of the bottom plate can be calculated by the following Equations 4.

$$\sigma_{g2t} = \sigma_{g1t} + \frac{M_{d2}}{Z_{gt}} \qquad \text{[Equations 4]}$$

$$\sigma_{g2b} = \sigma_{g1b} - \frac{M_{d2}}{Z_{gb}}$$

As indicated by the line 2, in the improved design method, the installation of the bottom plate only makes the stress in the lower margin of the girder approach the allowed tensile stress of the concrete and the upper stress approach the allowed compression stress of the concrete. At this stage, since the girder cannot bear the load any more, additional tension is introduced to decrease the tensile stress in the lower margin of the girder and the upper compression stress in the girder. Here, the stress $\sigma_{g3}$ in the profile synthesized with prestress by the secondary tension is obtained by the following Equations 5.

$$\sigma_{g3t} = \sigma_{g2t} + \frac{P_{i2}}{A_g} - \frac{P_{i2} \cdot e_2}{Z_{gt}} \qquad \text{[Equations 5]}$$

$$\sigma_{g3b} = \sigma_{g2b} + \frac{P_{i2}}{A_g} + \frac{P_{i2} \cdot e_2}{Z_{gb}}$$

Here, $P_{i2}$ is additional secondary tension, and $e_2$ is the eccentric distance of the secondary tension.

A line 3 indicates the distribution of stress in the profile calculated by Equations 5. Since the upper and lower margins of the girder can secure allowance with respect to the allowed stress by the prestress due to the secondary tension, the bending stress due to the dead load and live load of the bridge surface can be endured.

Synthesis Step

Figure 5:
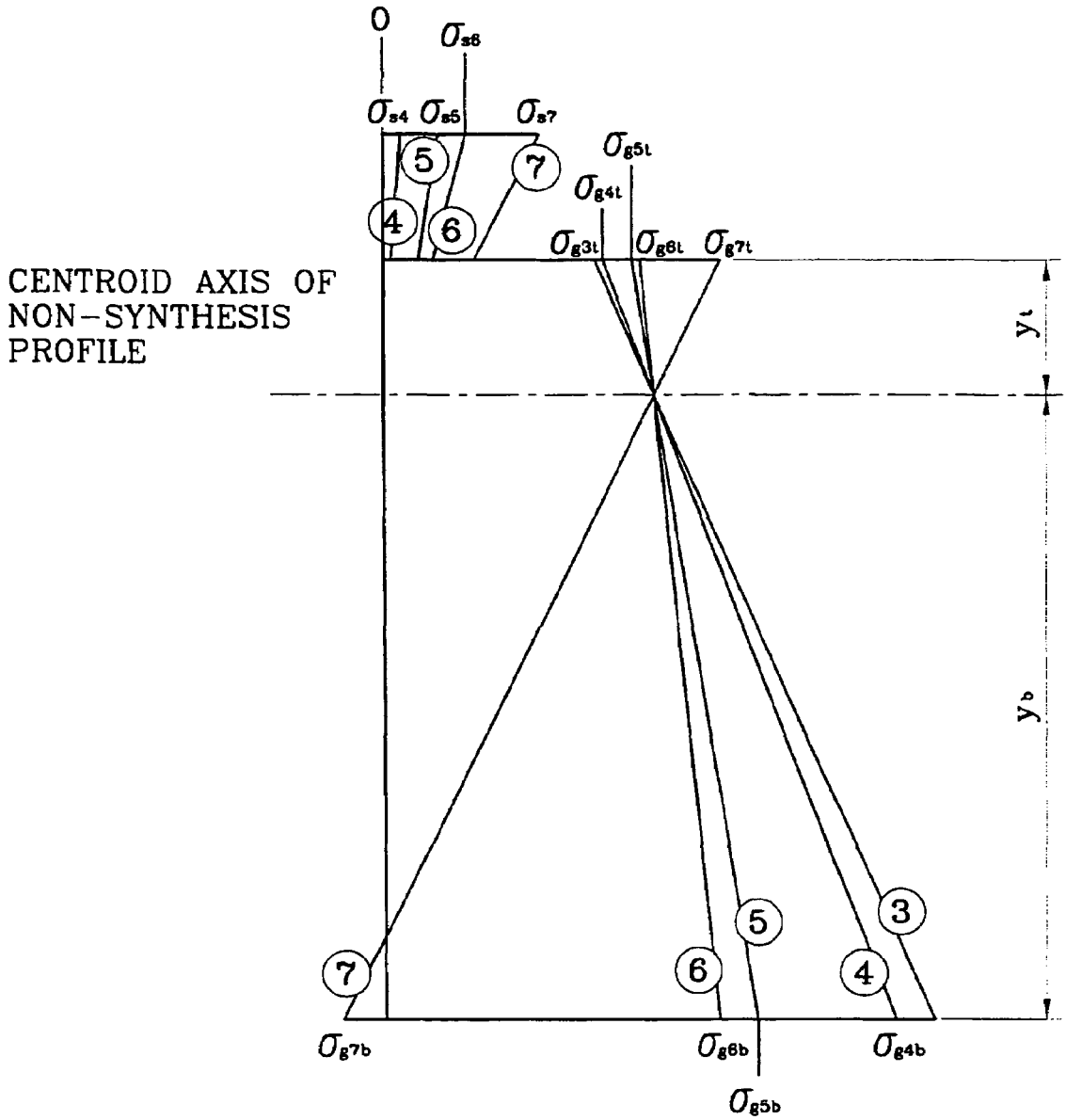
FIG. 5 is a graph showing the relationship between load and stress after a slab has been combined in a design method of the present invention.

FIG. 5 shows the relationship between a load and stress in the synthesis profile by the design method according to the present invention. In general, it is that about 50% of a long-term loss of tension is generated within four weeks. That is, while the bottom concrete plate solidifies, about half the long-term loss of tension occurs.

Given that an effective rate of tension with respect to the total long-term loss is R, the remaining amount of tension introduced twice will be $(1+R)(P_{i1}+P_{i2})/2$. Here, it is assumed that there is no time difference between loss of the primary tension and the secondary tension. Thus, the stress in the girder is distributed as indicated by a line 4 of FIG. 5. Here, as shown in FIG. 5, the girder acts as a synthesis profile after the bottom concrete plate is solidified. Also, a design variable with respect to the synthesis profile is used as a design factor such as a centroid axis and a profile coefficient.

The stress state of the upper and lower margins of the girder indicated by the line 4 can be obtained by the following Equations 6.

$$\sigma_{g4t} = \sigma_{g3t} + \left(1 - \frac{R}{2}\right)(P_{i1} + P_{i2})\left(\frac{1}{A_g} - \frac{e_{gp}}{Z_{gi}}\right) \qquad \text{[Equations 6]}$$

$$\sigma_{g4b} = \sigma_{g3b} - \left(1 - \frac{R}{2}\right)(P_{i1} + P_{i2})\left(\frac{1}{A_g} + \frac{e_{gp}}{Z_{gb}}\right)$$

Here, $e_{gp}$ is the eccentric distance with respect to the distribution of all tension members.

Also, the stress in the bottom concrete plate changes slightly due to the reduction of the tension. The stress $\sigma_{s4}$ in the upper margin of the bottom concrete plate can be obtained by the following Equation 7.

$$\sigma_{s4} = (R-1)(P_{i1} + P_{i2})\left(\frac{1}{A_c} - \frac{e_{cp}}{Z_{st}}\right) \qquad \text{[Equation 7]}$$

Here, $e_{ep}$ is the eccentric distance of the tension member with respect to the synthesis profile and $Z_{st}$ is the coefficient of the profile with respect to the upper margin of the bottom plate at the synthesis profile.

In the step of the line 4, when the bending stress generated by the bending moment $M_{d3}$ due to the dead load of the bridge surface such as pavement, curbstones and guide fences, is synthesized, the distribution of stress in the synthesis profile is the same as a line 5 indicates. Here, the stress in the upper and lower margins of the girder can be calculated as shown in the following Equations 8.

$$\sigma_{g5t} = \sigma_{g4t} + \frac{M_{d3}}{Z_{ci}} \qquad \text{[Equations 8]}$$

$$\sigma_{g5b} = \sigma_{g4b} - \frac{M_{d3}}{Z_{cb}}$$

Here, $Z_{ct}$ is a coefficient of the upper margin of the synthesis profile and $Z_{cb}$ is a coefficient of the lower margin of the synthesis profile.

Also, the stress in the upper margin of the bottom plate is shown in the following Equation 9.

$$\sigma_{s5} = \sigma_{s4} + \frac{M_{d3}}{Z_{st}} \qquad \text{[Equation 9]}$$

When it is assumed that the loss of tension by lapse of time has been completed just before the live load is applied, after the installation of a bridge has been completed, the compression stress in the lower margin of the girder is slightly reduced due to the final loss of the tension and the compression stress of the upper margin of the girder slightly increases. The distribution of stress at this stage is shown by a line 6 of FIG. 5 and the stress in the upper and lower margins of the girder can be obtained by the following Equations 10.

$$\sigma_{g6t} = \sigma_{g5t} + \frac{1-R}{2}(P_{i1} + P_{i2})\left(\frac{1}{A_c} - \frac{e_{cp}}{Z_{ct}}\right) \quad \text{[Equations 10]}$$

$$\sigma_{g6b} = \sigma_{g5b} - \frac{1-R}{2}(P_{i1} + P_{i2})\left(\frac{1}{A_c} + \frac{e_{cp}}{Z_{cb}}\right)$$

Also, the stress in the upper margin of the bottom plate is shown in the following Equation 11.

$$\sigma_{s6} = \sigma_{s5} + \frac{1-R}{2}(P_{i1} + P_{i2})\left(\frac{1}{A_c} - \frac{e_p}{Z_{st}}\right) \quad \text{[Equation 11]}$$

In a step in which the overall design live load including an impact is applied, as indicated by a line 7, a sufficient prestress has been introduced. Accordingly, even if an overload is applied, the member is not tensilely destroyed. That is, there are an over tension beam and a less tension beam according to whether the tensile stress of the power portion of the girder remains at a compression side or tensile stress is generated. The above case can be said to be a less tension beam. The stress in the upper and lower margins of the girder is obtained by the following Equations 12.

$$\sigma_{g7t} = \sigma_{g6t} + \frac{M_{(l+i)}}{Z_{ct}} \quad \text{[Equations 12]}$$

$$\sigma_{g7b} = \sigma_{g6b} + \frac{M_{(l+i)}}{Z_{cb}}$$

Here, $M_{(I+i)}$ is a design live load moment including an impact.

Also, the stress in the upper margin of the bottom concrete plate is shown in the following Equations 13.

$$\sigma_{s7} = \sigma_{s6t} \pm \frac{M_{(l+i)}}{Z_{st}} \quad \text{[Equations 13]}$$

As a result, as long as an excess load is not applied, in a step of using a bridge, the stress in the profile of the middle portion of the member exists between line 6 and line 7.

To summarize the above-described improved design method, primary tension is introduced to the girder having a low frame height. Since prestress by the primary tension supports only the bending moment due to the self-weight of the girder and the bottom plate, the cross-sectional area and height of the member are reduced, compared to the conventional design, so that dead load can be remarkably reduced. Secondary tension applied shortly after the installation of the bottom plate contributes to the introduction of prestress which enables the girder to withstand the dead load of the bridge surface and the live load moment. Consequently, it is a basic principle of the improved design method according to the present invention that prestress is introduced by an appropriate amount with respect to the load-stress relationship in each construction step, without introducing the prestress all at a time, so that the height of the profile can be reduced.

In general, as the span of girders of a bridge is lengthened, the portion of the bending moment due to the dead load becomes greater than the portion of the bending moment due to the live load in the overall design load. In the conventional design method in which prestress is introduced one time only, the ratio of the dead load moment to the live load moment for a span of 30 m or less is about 2–2.5. For a span of 50 m, the ratio increases to 3.5–4.0. This is because, as the span increases, the required eccentric distance capable of resisting a greater bending moment sharply increases so that the size of the profile increases. In the improved design method, while reducing the size of the profile of the member and the height of the member, such disadvantages of the conventional design method are compensated for.

The present invention may be used for a method of designing and fabricating a girder in a bridge. In particular, the present invention may be used for designing and fabricating a multi-step tension prestressed girder so that, as the span of a girder increases, a phenomenon that the portion of the bending moment due to the dead load is greater than that of the bending moment due to the live load in the overall design load is reduced.

What is claimed is:

1. A method for fabricating a prestressed girder comprising the steps of:

determining a first prestress to withstand a load including the girder weight and an allowable stress at a first construction step;

determining a second prestress to withstand an additional load and the allowable stress at a second construction step;

determining a suitable girder height based on the load, allowable stress, and the first prestress at the first construction step;

where the steps of determining the first and second prestress include assuming that a temporal loss of tension prestress is about half the long-term loss of tension prestress;

providing a girder having the determined girder height;

applying the first prestress to the girder at the first construction step; and applying the second prestress to the girder before subjecting the girder to the additional load at the second construction step.

2. The method of claim 1 wherein the girder includes a bottom plate, wherein the first construction step occurs before installation of the bottom plate, and wherein the second construction step occurs after installation of the bottom plate.

3. The method of claim 1 wherein the girder is molded, and wherein the first prestress determination occurs for load and stress conditions existing when the girder is molded.

* * * * *